US005201521A

United States Patent [19]

Healy

[11] Patent Number: 5,201,521

[45] Date of Patent: Apr. 13, 1993

[54] PUTTING PRACTICE AND GAME APPARATUS

[76] Inventor: Charles W. Healy, 723 - 12th St., SW., Massillon, Ohio 44646

[21] Appl. No.: 673,735

[22] Filed: Mar. 22, 1991

[51] Int. Cl.[5] ..... A63B 69/36

[52] U.S. Cl. ..... 273/176 K; 273/176 H; 273/179 R; 273/180

[58] Field of Search ..... 273/176 R, 176 D, 176 F, 273/176 H, 176 K, 34 R, 34 A, 178 B, 179 R, 179 C, 179 E, 182 R, 182 A, 183 A, 195 R, 195 B, 32 R, 180, 122 R, 125 R

[56] References Cited

U.S. PATENT DOCUMENTS

| | | | |
|---|---|---|---|
| 1,558,766 | 10/1925 | Smith | 273/179 R |
| 1,612,291 | 12/1926 | Jackson | 273/178 B |
| 1,798,140 | 3/1931 | Byers | 273/179 C |
| 1,904,034 | 4/1933 | Walstrom | 273/176 H |
| 2,334,540 | 11/1943 | Buffham | 273/176 H |
| 3,341,207 | 9/1967 | Shusda | 273/179 C |
| 3,572,720 | 3/1971 | Berg | 273/176 F |
| 3,588,117 | 6/1971 | Hertenstein | 273/176 FA |
| 4,875,682 | 10/1989 | Paolillo | 273/176 F |

FOREIGN PATENT DOCUMENTS

| | | | |
|---|---|---|---|
| 448839 | 4/1968 | Switzerland | 273/176 F |
| 30552 | 5/1931 | United Kingdom | 273/34 A |

*Primary Examiner*—Mark Graham

*Attorney, Agent, or Firm*—Oldham, Oldham, & Wilson Co.

[57] ABSTRACT

A putting practice and game apparatus is disclosed, which is simple, cost effective device which may be portable and is easily constructed for use. The apparatus comprises an elongated playing surface which has at least one target hole positioned adjacent one end thereof, toward which golf balls or the like are putted. The playing surface is supported at one end thereof by a lift base which is positioned in spaced relation to the end of the playing surface. The lift base allows the playing surface to be pivoted upwardly about the lift base such that the end of the playing surface may be selectively raised. This action allows any balls on the playing surface or within any holes on the playing surface to be returned to the user positioned at the other end thereof. The playing surface may be adjusted to provide an unlimited number of variations in the shape of the playing surface presented for putting. The ball return mechanism of the invention may include return channels, which rely upon the selective inclination of the playing surface to return balls contained therein. Of particular importance in the structure is the at least one hole provided in the apparatus, which is adapted to retain a desired number of balls and allows the balls to be ejected therefrom upon inclination of the playing surface.

13 Claims, 4 Drawing Sheets

PUTTING PRACTICE AND GAME APPARATUS

BACKGROUND OF THE INVENTION

This invention generally relates to a putting practice and game apparatus which can be used in a relatively small area either indoors or outdoors. More particularly, the invention relates to a putting practice and game apparatus which is adjustable for a variety of putting shots and allows balls to be returned selectively by the user.

In the recent past, the game of golf has become increasingly popular, and the need for practicing has become apparent. Additionally, many people have found that putt-putt golf courses or similar putting games are an enjoyable recreational activity. Various apparatus have been developed for allowing one to putt indoors for practice in perfecting ones putting skills, or allowing a putting game to be played therewith. In many aspects, prior art indoor putting apparatus are deficient. For example, such apparatus may not be adaptable to provide variable putting surfaces which allow putting to be varied for a continual challenge. Most of the prior art putting apparatus are relatively simple in construction and use and putting therewith becomes routine and less beneficial after a short time. Additionally, such games do not accurately simulate actual putting on a golf course except in a remote sense, and do not provide undulating or variable surfaces for putting on. It has also been a desirable feature to provide for all return to enable the user to practice efficiently or more easily. Such ball return features have been generally unreliable and many times comprise a relatively complicated construction.

An example of a putting practice apparatus in the prior art is shown in U.S. Pat. No. 4,240,637, which consists of a deck having an upper putting surface which allows variable adjustment with respect to a base portion thereof. Several height adjustment devices allow the height of the deck surface to be changed and the magnitude of the slope to be modified. The apparatus includes one hole which communicates with the interior of the apparatus and various channel pathways for return of a ball falling therein. In many instances, the use of return channels in various putting devices have lead to problems in reliably and efficiently returning all balls hit by the player. It is also noted that variation of the playing surface in this prior patent is limited to initially adjusting the plane of the playing surface and not necessarily its shape.

Another putting practice device is shown in U.S. Pat. No. 3,856,313, which includes a frame structure having gutters along the side thereof for return of balls hit into the holes on a playing surface communicating therewith. Similar problems exist with such return mechanisms, and such constructions must necessarily e somewhat complex and cumbersome in their construction and assembly. In U.S. Pat. No. 3,595,581, there is shown a simulated golf green formed on a large platform which may be distorted to a plurality of non-planar forms. Although variability in the playing surface is accomplished, the apparatus is quite complex and too large to provide a portable and easily used device. Similarly, a simulated putting green is shown in U.S. Pat. No. 3,580,583, which again includes the use of ball return channels. In many apparatus which use ball return channels, such channels must necessarily be positioned to afford a downhill path after the ball falls therein. This structure will necessarily require adding height to the apparatus which under many circumstances is undesirable. Other complex structures simulating golf greens have been developed, for example in U.S. Pat. No. 3,522,947.

Additional examples of putting games have been developed as shown in U.S. Pat. Nos. 3,424,463 and 1,784,863, all of which utilize various cumbersome forms in an attempt to provide some mechanism to return putted balls to the player. In all of the above devices, there is not found a simple and effective putting practice and game apparatus which allows balls to be returned easily and effectively, while not adding significantly to the height, complexity or cost of the apparatus.

SUMMARY OF THE INVENTION

Based upon the foregoing, there has been found a need to provide a putting practice and game apparatus which avoids the disadvantages as found in the prior art. It is therefore a main object of the invention to provide a putting practice and game apparatus which is simple and cost effective in its construction, is portable and simply assembled by the user, and yet allows putting to be performed with unlimited shot variability and return of the putted balls selectively by the user.

It is another object of the invention to provide a putting practice and game apparatus which may be formed in adjustable lengths, and allows the putting surface to be varied in an unlimited number of ways.

Yet another object of the invention is to provide a ball return mechanism which is extremely reliable and easily used to effectively return any putted balls to the initial standing position of the player.

Another object of the invention is to provide a hole construction which allows putted balls to drop and be retained therein, but which will allow the golf balls to be automatically removed therefrom upon actuation of the ball return mechanism by the user.

These and other objects and advantages of the invention are accomplished by a putting practice and game apparatus comprising an elongated playing surface which may be of any of a variety of lengths and which is constructed of a soft, resilient material which simulates the surface of a putting green. The playing surface is supported at one end thereof by a support frame and a lift base is attached to the support frame in spaced relation to the end of the playing surface. Means associated with the lift base allow the support frame to be pivoted upwardly about the lift base so as to allow the end of the playing surface supported on the frame to be selectively raised wherein any balls on the playing surface or within any holes on the playing surface will be returned to the user positioned at the other end of the playing surface. By allowing the playing surface to be actually, physically inclined in a selective manner, the use of elaborate structures to provide ball return is avoided, and the construction is extremely simple and cost effective. The ball return mechanism of the invention also avoids complications which may arise in more elaborate ball return structures, and is therefore extremely effective to consistently return any putted balls. The support frame means of the invention may include means to adjust the playing surface easily and effectively to provide an unlimited number of variations in the shape of the playing surface presented for putting. The length of the apparatus is easily modified for very long putts, and may be simply used for shorter putts as desired. The ball return mechanism of the invention may include return channels, but wherein the return channels are not provided as initially forming a downwardly inclined surface where balls will be returned by gravity. Instead, the ball return channels rely upon the selective inclination of the support frame, which avoids any potential problems associated with the return channels. Of particular importance in the structure is the at least one hole provided in the apparatus, which is adapted to retain a desired number of balls and allows the balls to be ejected therefrom upon inclination of the support frame means. A variety of other advantageous characteristics and modifications will be set forth as the description proceeds.

BRIEF DESCRIPTION OF THE DRAWINGS

The objects and advantages of the putting practice and game apparatus of the invention will become apparent upon a further reading of the detailed description in conjunction with the drawings, wherein.

DETAILED DESCRIPTION OF THE INVENTION

Figure 1:
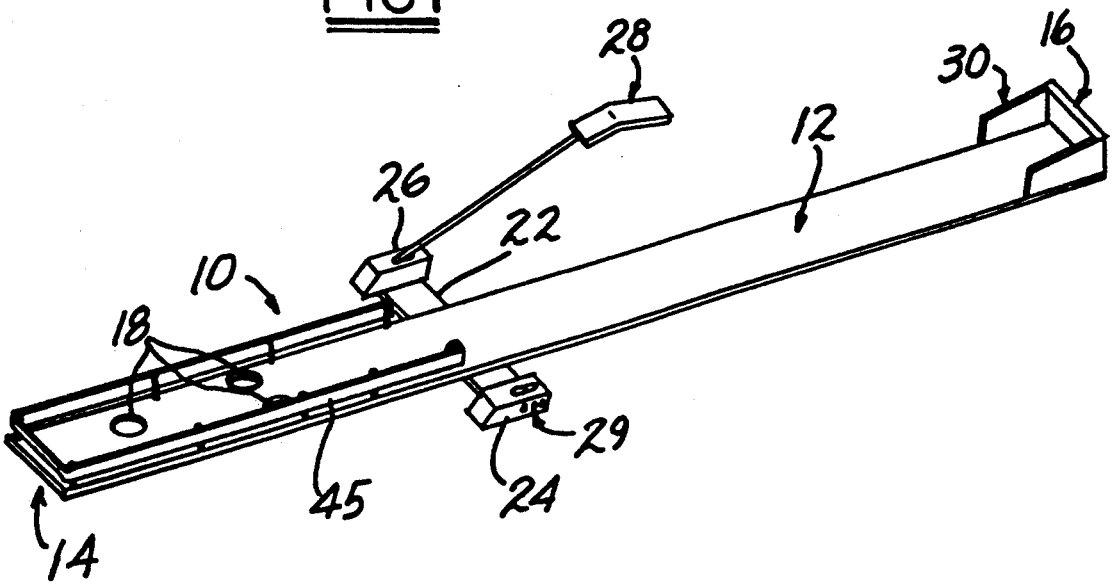
FIG. 1 is a perspective view of a first general embodiment of the invention.

Turning now to FIG. 1, a first embodiment of the putting practice and game apparatus is generally shown at 10, the apparatus having an elongated playing surface 12 with a first end 14 and a second end 16. The playing surface may comprise a soft, resilient material such as felt, foam rubber, carpet or the like which simulates the putting surface on a putting green. At the first end 14 of apparatus 10 is a plurality of target holes 18 situated at various positions on playing surface 12 and forming individual targets for the player. The player will stand adjacent the second end 16 of playing surface 12, at a location to putt balls towards holes 18. The length of the playing surface 12 may be variable, ranging from short putts to very long putts of 20 feet or more. It should be recognized that the apparatus 10 allows a user to putt short distances on a longer playing surface 12 by simply moving towards the holes 18. The height of the playing surface 12 above the floor level may be only several inches along its length, and therefore a user may utilize the entire surface for practice or otherwise.

As will be described in more detail hereinafter, the first end 14 of the playing surface 12 is supported on a lift frame 20 which extends to the location of a lift base 22 associated with the frame means 20. The lift base 22 is a rigid member which may have end blocks 24 and 26 on each side of playing surface 12 in which may be housed a ball return actuating lever 28. By means of the lift base 22 in conjunction with the actuating lever 28, the entire frame means 20 and first end 14 of playing surface 12 are inclined to return any balls putted on playing surface 12. At second end 16 of playing surface 12 may be provided a backstop 30 adapted to catch and retain any balls which are returned along playing surface 12.

Figure 2:
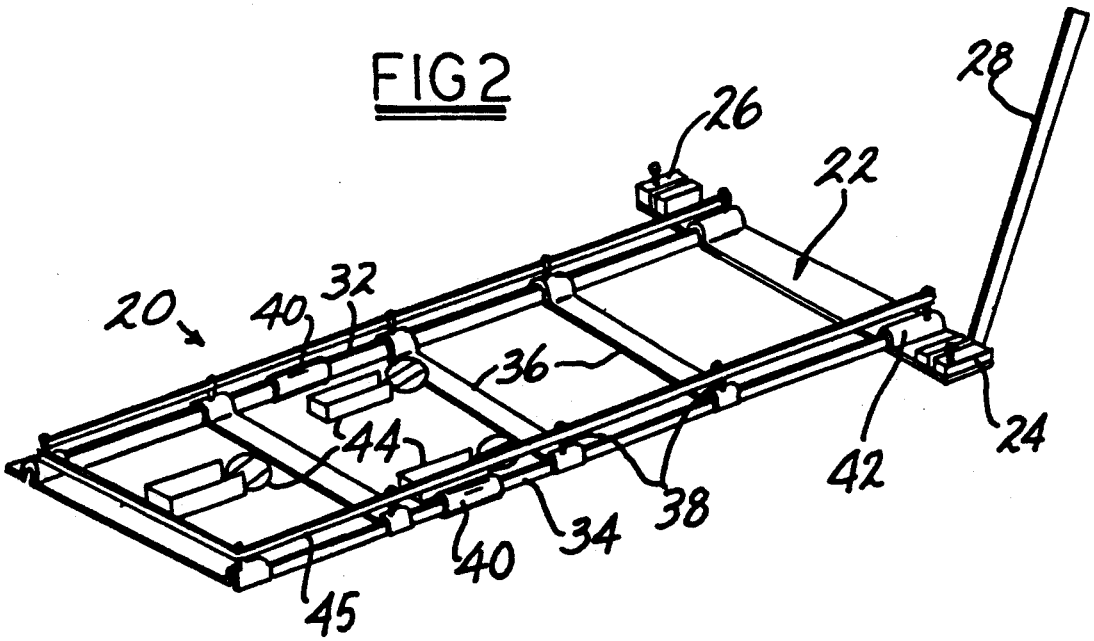
FIG. 2 is an enlarged partial perspective view of the support frame associated with the putting apparatus, having various structure removed for clarity of description.

Turning to FIG. 2, the lift frame means 20 and lift base 22 are shown in more detail. The lift frame 20 generally comprises two elongated side members 32 and 34, which may be attached by means of one or more cross bars 36 which are adapted to space the side members 32 and 34 a predetermined distance from one another. Each of the cross bars 36 may be attached to the side members 32 and 34 by means of thumb screw 38 or the like, which as will be seen may affect adjustments in the configuration of the playing surface 12 positioned on top of frame 20. The elongated side members 32 and 34 may be adjustable in length by providing them as a plurality of individual members coupled by means of a coupling sleeve 40. The side members 32 and 34 may also be coupled to the lift base 22 in slots 42 formed adjacent the edges thereof. The lift base 22 in the preferred embodiment is a sturdy, strong member having the strength to carry and support the frame 20 in an inclined position without substantial deformation thereof. The lift base 22 further includes mounting blocks 24 and 26 which are adapted to mount and support the actuating lever on either of both of the right or left hand sides of the playing surface 12. Thus, either right or left handed players may use the putting apparatus easily and effectively. The actuation lever 28 may be simply inserted in a slot formed in the mounting blocks 24 or 26 and bolted into position or the blocks 24 and 26 may be provided with an angled aperture which is adapted to accept lever 28 and maintain its position when downward pressure is exerted on the other end of lever 28. The mounting blocks 24 and 26 may also comprise means 29, such as a bolt extending through apertures in the supporting blocks 24 or 26 against which the lever 28 will rest, to enable adjustment of the angle of the actuating lever 28. This adjustment will enable the lever 28 to be extended towards the player at various heights and distances to enable putting at different lengths with the actuation lever properly positioned relative to the player.

It should be apparent that any other similar type of actuating assembly adapted to lift the end of playing surface 12 supported by frame 20 to an inclined position for return of balls to the player is contemplated and within the scope of the invention. For example, for very short putts, an actuating means may be provided on the first end 14 of the apparatus which may simply be pulled upwardly by the player standing nearer this end. In this situation, the lift base may be eliminated if desired. It should also be apparent that the lift base 22 could be modified to allow more room around playing surface 12, to thereby allow the apparatus 10 to be used for any length putt without hinderance from lift base 22 or actuating lever 28. It is also seen in FIG. 2, that a plurality of ball retaining hole members 44 are adapted to be positioned under the plurality of holes 18 such that any balls falling in holes 18 will be retained within hole members 44. The hole members 44 are retained in the proper position beneath holes 18 formed in the playing surface 12 and are adapted to eject balls contained therein upon inclination of the first end 14 of playing surface 12. There is also provide a border assembly 45 which may comprise an elastic strap supported on a plurality of upwardly extending posts so as to surround the first end 14 of playing surface 12. The border assembly 45 will retain all balls on playing surface 12 until return thereof is desired by selective actuation of the ball return mechanism.

Figure 3:
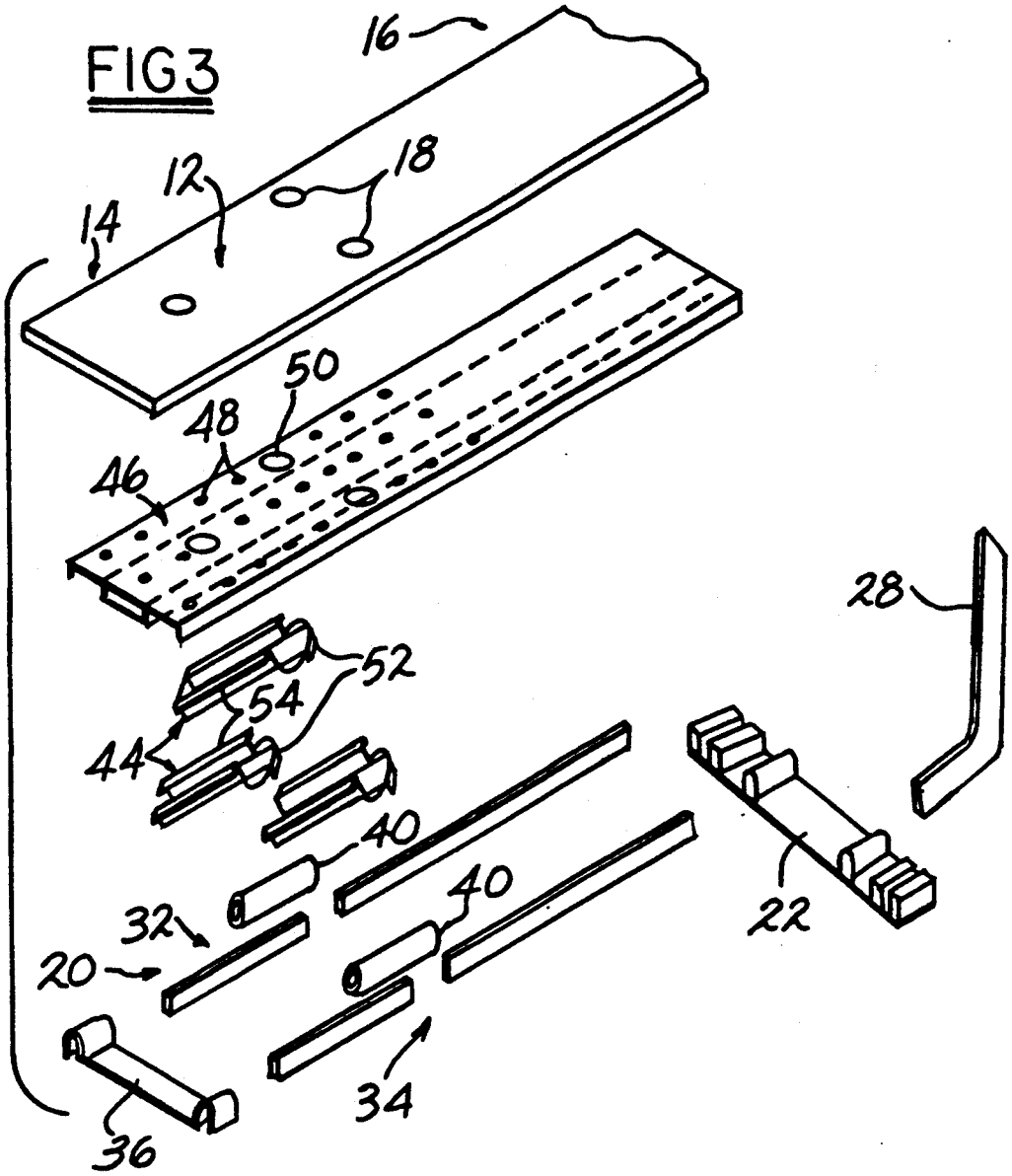
FIG. 3 is an exploded partial view of the playing surface, the support frame, and holes of the apparatus.

Turning now to FIG. 3, the various components of the putting practice and game apparatus are shown as they are assembled in the embodiment of FIG. 1. The playing surface 12 as previously described, may be a soft flexible pad constructed from many of a variety of materials such as felt, foam rubber, artificial grass or the like. The length of the playing surface 12 is variable, and is preferably constructed as a one-piece member, a portion of which is adapted to be supported on the floor, ground or other hard surface, and a portion of which is to be supported on the lift frame 20 as described in FIG. 2. On the lift frame 20, there may be positioned a supporting base member 46 which may comprise a sheet or plurality of sheets of relatively rigid material such as hardboard, cardboard, plastic, styrofoam or any other suitable material which has rigidity to provide a supporting base for the playing surface 12. In the preferred embodiment, the supporting base member 46 comprises a relatively lightweight material so as to allow easy actuation of the ball return structure of the invention, and yet a strong and durable material to withstand repeated use of the apparatus. The supporting base member 46 will be attached to the lift frame 20 by means of the thumb screws 38 or additional fastening means of any suitable type. Also in a preferred embodiment, the supporting base member 46 may include a plurality of holes 48 which may be utilized for fastening of member 46 to the support frame, and/or may be used in conjunction with adjusting means to allow adjustment of playing surface 12 positioned thereon. It should be recognized that the adjustment means such as screws 38 may extend through the apertures 48 and above the upper surface of supporting base member 46 so as to induce localized variation of raised areas in the playing surface 12. Other similar adjusting means may be simply provided in association with the holes 48 to affect such adjustment at any position on playing surface 12. The position and number of holes 48 is variable, and as should be evident will provide essentially unlimited variation in the configuration of playing surface 12 by adjusting the height of various adjustment means associated with supporting base member 46.

The target holes 18 formed in playing surface 12 will have corresponding holes formed in the supporting base member 46 as seen at 50, which again may be provided in any number and position as desired. Beneath the holes 50 of the supporting member 46 are provided a plurality of ball retaining hole members 44 as described with reference to FIG. 2. The ball retaining members 44 include tab means 52 and 54 which are adapted to engage the base supporting member 46 so as to position and maintain hole members 44 at the proper location beneath holes 50 thereof. The ball retaining hole members 44 will be described in more detail as the description proceeds.

The base supporting member 46 is adapted to be supported and retained on the lift frame 20 of the apparatus. Again, the frame 20 may comprise a pair of elongated side members, each of which may comprise one or a plurality of individual lengths, which is shown in FIG. 3 may be two lengths which are secured to one another by coupling sleeves 40. At least one cross beam support member 36 may be utilized to secure side members 32 and 34 in a spaced apart substantially parallel relationship, having a width to enable the base supporting member 46 to be positioned and supported thereon. Each of the side members 32 and 34 are secured to a lift base 22 which in turn is coupled to one or more actuating levers 28 as previously described. It should be understood from FIG. 3 that the supporting base member 46 and lift frame structure 20 has a length which is shorter then that of playing surface 12 such that one end of the playing surface 12 may be inclined along with the supporting frame 20 and supporting base member 46 for return of balls putted toward first end 14 or into the ball retaining hole members 44. The first end 14 which is supported on base member 46 and lift frame 20 which will necessarily raise the playing surface 12 slightly above floor level, but the height of the playing surface 12 at the location of the supporting frame 20 is still extremely small. The overall change in height of the playing surface 12 over its length is almost non-perceptible, and thus the user is not continually faced with attempting to putt on an upward grade which is less than realistic with regard to actual putting situations. It should also be recognized that an additional supporting base member may be provided from the location of supporting frame 20 to the second end 16 of playing surface 12, such that a completely level surface is provided which can then be adjusted using adjustment means associated with the supporting base members.

The putting practice and game apparatus as described is comprises of relatively few parts which are easily assembled into the configuration as described for us. The apparatus is extremely light weight, and may be disassembled and packaged to provide portable apparatus which may be easily carried to any desired location and quickly assembled for us. It has also been recognized that the playing surface 12, which is preferably an elongated integral piece of material, can be utilized as a sort of carrying case by folding the material to form a pouch-type configuration in which the other components of the apparatus may be placed and carried.

Figure 4:
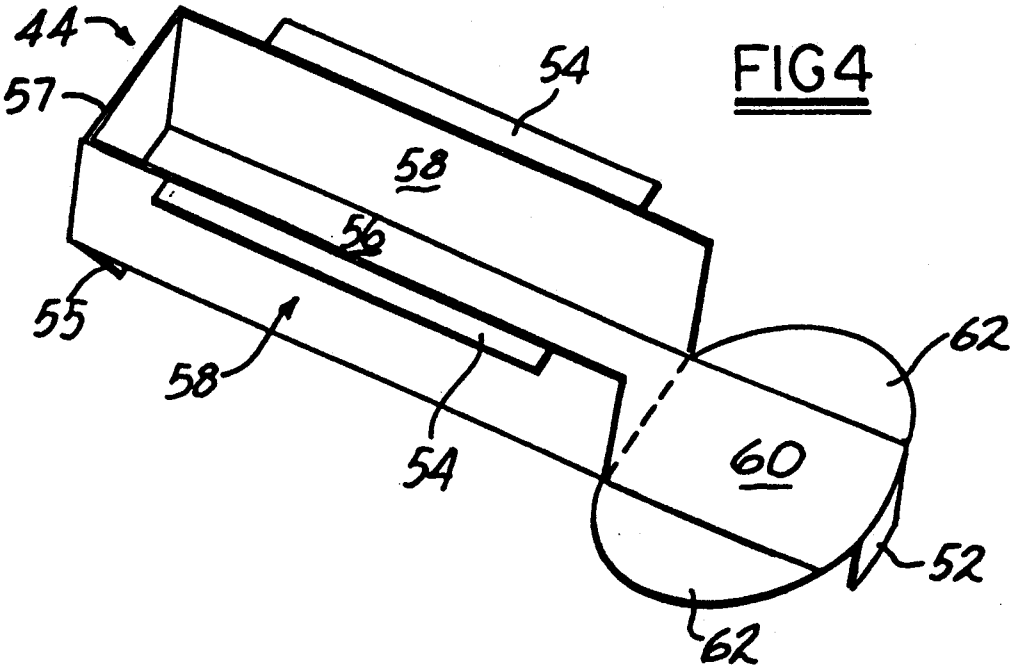
FIG. 4 is an enlarged perspective view of the ball retaining hole associated with the apparatus.

Turning now to FIG. 4, a ball retaining hole member 44 of the invention is shown in more detail. The ball retaining hole member 44 includes a bottom surface or ramp 56 bounded by back and side walls 57 and 58 respectively. This structure forms a channel having a width to at least accommodate the diameter of a golf ball or the like, and a length to accommodate a plurality of such balls therein. At the front of the ball retaining hole member 44 is an upwardly inclined bottom surface 60, which extends upwardly to the lip of the hole 50 formed in the supporting base member 46 of the apparatus. Adjacent the upwardly inclined bottom surface 60 are a pair of wings 62 which extend upwardly and inwardly toward bottom surface 60. Any ball entering the ball retaining member 44 will be directed into the channel down the inclined surface 60, and will not be allowed to escape at the sides by means of wings 62. The ball retaining hole member 44 may be provided with a tab 52 adapted to secure member 44 in the proper position at the leading edge of a hole formed in base member 46 or playing surface 12, as well as tabs 54 which may be secured to an under side of the base support member 46 as desired. An additional tab 55 or other fastening structure may be provided at the back edge of the ball retaining member 44 so as to be secured to a cross beam support 36 of the supporting frame structure 20 as previously described. Any suitable fastening means may be provided with the ball retaining member 44 in order to properly secure members 44 in a position beneath the holes formed in playing surface 12. The ball retaining member 44 are also adapted to eject any balls retained therein upon upward inclination of the playing surface 12 and supporting structure therefore. It should be evident that upon upward inclination of the ball retaining member 44, the bottom surface 56 of the channel will be inclined to urge balls outwardly of member 44. Any balls retained in member 44 will be ejected through the hole 18 of playing surface 12 and will roll down inclined playing surface 12 so as to be returned to the player.

Figure 5:
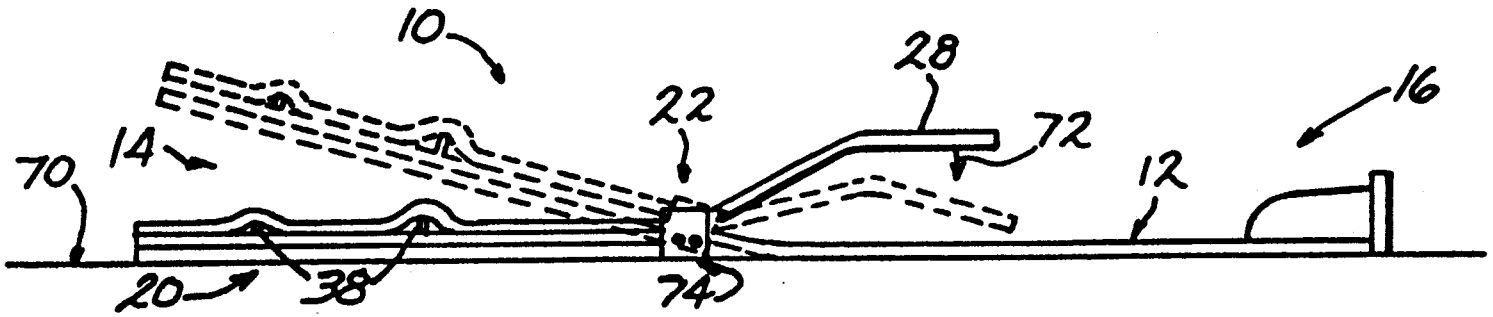
FIG. 5 shows the relative positionings of the support frame associated with the apparatus for return of balls on the playing surface or in the holes thereof.

In operation, the playing surface 12 will initially present a substantially horizontal surface along the ground plane as shown in the solid lines of FIG. 5 on which a player will putt. As seen in FIG. 5, the playing surface 12 has its second end 16 resting on the ground or floor surface 70 along a significant portion of its length. The first end 14 of the playing surface 12 rests on the supporting frame structure 20 as previously described, and lifting base 22 is situated toward second end 16 of playing surface 12. The frame support structure 20 is firmly connected to the lifting base 22, and is relatively light weight such that it may be carried and supported by the lift base 22 in the construction. Associated with the lift base 22 is the actuating lever 28 which is coupled to the supporting blocks of lift base 22 on one or both sides thereof. The actuating lever 28 extends towards the second end 16 of playing surface 12 at which point a player will be positioned for utilizing the apparatus 10 to practice putting or to play various putting games. A plurality of balls may be putted from the second end 16 towards first end 14 of playing surface 12, at which a plurality of target holes may be provided. As previously mentioned, the bolt 38 or other means to secure the supporting frame 20 together may also be utilized to vary the configuration of the playing surface 12 positioned thereon. The adjusting means 38 may be adjusted to extend upwardly from supporting frame 20 so as to create a raised portion on playing surface 12 of any desired height. The number and position of such adjusting means 38 may be modified to allow significant variations to be achieved in the configuration of playing surface 12 as desired.

After a number of balls have been putted towards target holes on first end 14 of playing surface 12, the player may desire to retrieve the putted balls to continue practice or the playing of various putting games. To retrieve the putted balls, the actuating lever 28 is depressed downwardly as shown by arrow 72 by the player using the apparatus 10. The actuating lever 28 extends towards the second end 16 of playing surface 12 at which point the player will be standing to perform putting on the apparatus, and depression of the actuating lever 28 may be performed by the putter, hand, foot or otherwise of the player. Upon depression of the actuating lever 28, the lift base 22 is pivoted about pivot point 74, which in turn raises the entire supporting frame 20 to the position as seen in the broken lines of FIG. 5. As the lift base 22 is pivoted about point 74, the first end 14 of playing surface 12 is inclined to a sufficient height such that any balls located on this portion of playing surface 12 will be caused to roll toward second end 16 and back to the player positioned adjacent thereto. As mentioned previously, the target holes provided in the first end 14 of playing surface 12 in conjunction with the supporting frame 20 are designed to eject any balls contained therein, so that these also will be returned to the player at the second end 16 of playing surface 12. It should be recognized that balls are returned quickly and easily by simply depressing the actuating lever 28 to raise the first end 14 of playing surface 12 as seen in FIG. 5. This ball return structure allows extremely effective ball return without adding substantially to the structure or complexity of apparatus 10. The apparatus 10 thereby remains simple and cost effective in its construction, and yet provides efficient and effective ball return as desired in the apparatus.

Figure 6:
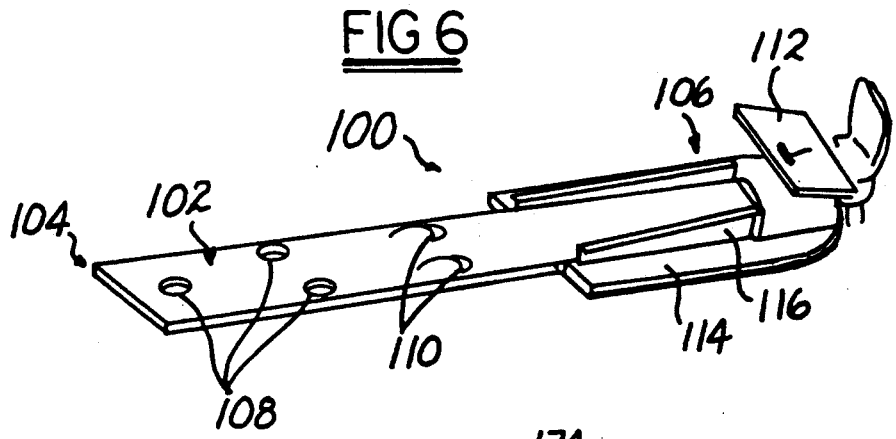
FIG. 6 shows a perspective view of an alternate embodiment of the putting apparatus of the invention.

Turning now to FIG. 6, an alternative embodiment of the present invention is shown, wherein the putting apparatus 100 again includes an elongated playing surface 102 having a first end 104 and a second end 106. Adjacent the first end 104 are a plurality of target holes 108, towards which balls are putted by a player standing adjacent end 106. Additional holes 110 are provided in playing surface 102 which are connected to the ball return mechanism of the apparatus, wherein balls putted into holes 108 will be returned to the player standing adjacent end 106 through the return holes 110. Also provided at end 106 may be a scoring table 112 and control means for initiating the ball return mechanism as well as a ball ejection feature to be described hereinafter. There may be provided in this embodiment a platform 114, on which a player may stand to perform putting on the apparatus. There may also be provided rigid plastic covers 116 which are adapted to enclose a portion of the return mechanism associated with the apparatus, so as to hide this structure from view for an aesthetically pleasing appearance.

Figure 7:
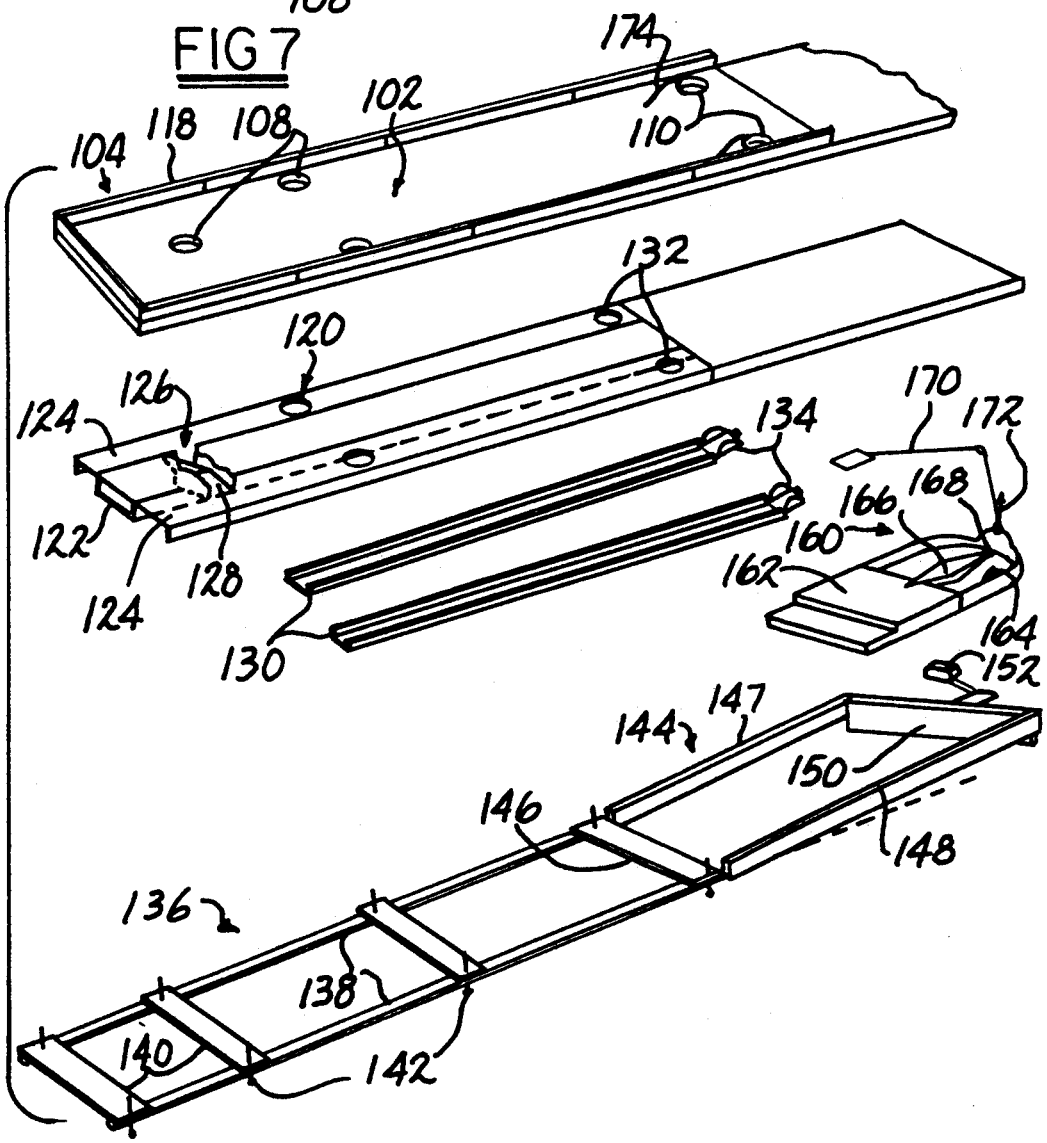
FIG. 7 shows a exploded perspective view of the apparatus as seen in FIG. 6.

The apparatus as seen in FIG. 6 is shown in more detail in FIG. 7, wherein the playing surface 102 is again comprised of a soft, resilient material such as felt or the like. The length of the playing surface 102 may be variable as previously described, and an elastic border 118 may be positioned around the periphery of playing surface 102 especially adjacent end 104 thereof. The border 118 will retain any putted balls on the playing surface 102, such that any putted balls will be returned to the player upon actuation of the ball return mechanism. The playing surface 102 is supported on a support base 120 to which the playing surface 102 is attached along its length. The support base 120 may be comprised of an elongated rigid member 122 which extends a portion of the length of playing surface 102 and may be situated along the center region thereof. On either side of support member 122 may be provided support wings 124 which may be pivotally attached to support member 122 such that each of the wings 124 may be variably oriented relative to support member 122.

Also provided in association with support base 120 is a center hole means 126 forming a portion of the ball return mechanism of the apparatus. The hole means 126 is situated beneath a center hole 108 on the playing surface 102. The hole means 126 comprises two downwardly inclined ramps 128 extending from a mid-portion thereof, such that balls dropping into the center hole 108 will be directed towards one or the other of the side wing portions 124 thereof. The downwardly inclined ramps 128 essentially form channels to direct balls outwardly from the center region of the support member 120. Each of the downwardly inclined ramps 128 of the hole means 126 is thereafter coupled to a ball return channel 130 situated beneath each wing 124 of the support base 120 The hole means 126 will thus direct any balls falling into a center hole 108 to one of the ball return channels 130 for subsequent return to the player upon selective operation of the ball return mechanism. The ball return channels 130 are coupled to a pair of holes 132 formed in support member 120 and cooperating with return holes 110 on playing surface 102. The return channels 130 may include an inclined portion 134 adjacent the holes 132, such that the balls rolling down return channels 130 will roll up the incline surfaces 134 and will be ejected through holes 132 and 110 so as to be returned to the playing surface 102 as will be hereinafter described. When the support member 120 is laid flat on a floor or other surface, the ball return channels 130 will be slightly upwardly inclined from their attachment to hole means 126 to their coupling position at holes 132. It should also be recognized that the return channels 130 are situated directly beneath holes provided in wing portions 124 such that any balls putted into these holes fall into the return channels 130. Thus, any balls putted into any of the holes 108 on playing surface 102 will be directed into the ball return channels 130, and will be retained within return channels 130 adjacent end 104 of the apparatus until initiation of the ball return mechanism. The hole means 126 associated with the support member 120 may also have the downwardly inclined channels 128 thereof oriented in a direction toward end 106 of the apparatus. A large number of balls may be positioned within the hole means 126, and will be urged outwardly towards return channels 130 and in a direction toward the position of the player.

The ball return structure of this embodiment includes hole means 126 and return channels 130 which work in conjunction with a lift base 136 carrying the support member 120 as well as playing surface 102 and their associated structure. The lift base 136 is in many respects similar to that previously described, and may be comprised of a pair of rigid elongated side members 138, which may be attached by means of one or more cross bars 140. Along the length of the side members 138 may be provided a plurality of adjustment means 142 which are adapted to engage the wing portions 124 of the support base 120. The adjustment means 142 may comprise bolts or the like, wherein the height of the bolt extending above lift base 136 will vary the orientation of the wing portions 124 relative to the center member 122 and along their length. Adjustment of the playing surface 102 may also be affected by similar means to that previously described. The elongated side members 138 are adapted to be positioned on the floor, ground or other flat surface, and will rest thereon when the apparatus is in the playing position. As in the previous embodiment of the invention, the lift base 136 is a sturdy, strong member adapted to carry and support the support base 120 and playing surface 102 positioned thereon when the ball return mechanism is initiated which will result in inclination of lift base 136 and the support base 120 and playing surface 102 in conjunction therewith. Contrary to the previous embodiment, lifting of the lift base 136 is accomplished by means of a pivot frame 144 coupled to lift base 136 about a pivot support member 146. The pivot frame 144 comprises frame members 147 and 148 which are coupled to lift base 136 in an upwardly inclined orientation relative thereto. A weight bar 150 couples frame members 147 and 148 adjacent end 106, which has associated therewith a return lever 152.

In operation, when a player desires any putted balls to be returned, the return lever 152 is pulled toward end 106, such as by a person seated at score table 112 which will force weight bar 150 downwardly causing the lift base 136 to be raised upwardly about pivot point 146. In this way, the entire end 104 of the apparatus will be lifted to a degree such that balls on playing surface 102 will roll back to end 106 as desired. Additionally, it should be recognized that upon lifting of lift base 136, the ball return channels 130 will now be downwardly inclined from end 104 towards end 106 of the apparatus, wherein any balls within hole means 126 or return channels 130 will be directed down channels 130 to be ejected onto playing surface 102 for return to the player. It is only upon lifting of lift base 136 that gravity will act on any balls located in the return channels 130 so as to urge them toward the player positioned adjacent end 106 of the apparatus.

There may also be associated with the apparatus 100 a ball storage and retrieval assembly 160 which may be positioned at the end 106 of playing surface 102 so as to accept balls returned toward this end by actuation of the ball return mechanism. The assembly 160 may comprise a coupling platform 162 which is adapted to slide beneath end 106 of the playing surface such that the playing surface 102 will be flush with the top portion of platform 162. Balls returned using the ball return mechanism will thus roll off end 106 onto platform 162 and into a trough 164 of the assembly 160. The trough 164 is adapted to store and retain a large number of balls therein, and is adapted to retrieve one ball from the stored balls when desired by the player. The retrieval structure includes a ball runway 166 which is an upwardly inclined surface which extends onto and slightly above platform 162. The front portion of runway 166 will thus deflect any balls returning to trough 164 along playing surface 102 to ensure that returning balls will be directed into trough 164. The bottom of trough 164 is downwardly inclined to a slight degree such that balls positioned will be issued towards the back edge. An indented region 168 is formed at the back edge of runway 166, and is adapted to isolate and retain therein a single ball to be selectively retrieved by the user. Also coupled to the trough 164 is an actuating lever 170 which will be secured at a position adjacent scoring table 112 such that lever 170 may be depressed to result in lifting of the trough 164 as indicated by arrow 172.

In operation, balls returned toward end 106 upon actuation of the ball return mechanism will be disposed within trough 164 and will be issued towards the back edge thereof, wherein a single ball will be positioned in the area 168 for selective retrieval. When retrieval of a ball is desired, the actuating lever 170 is depressed resulting in lifting of trough 164 wherein the single ball positioned in area 168 will be made to roll on runway 166 and back onto playing surface 102. Any other balls positioned within trough 164 will roll to the front thereof upon actuation of lever 170, and will therefore not affect retrieval of the ball along runway 166. It has additionally been found that by allowing all balls within trough 164 to move upon actuation of lever 170, after lever 170 is released, another ball is readily positioned within area 168 for subsequent retrieval. This structure has been found to be a relatively simple, cost effective construction which yields consistent retrieval of a single ball selectively by the player.

It should be recognized that various features as described with the embodiment of FIG. 6 may be utilized in the embodiment of FIG. 1 or vice versa, to achieve any of the desired features of the invention. It should also be recognized that although return channels are utilized in the ball return system, the inherent problems associated with return channels are avoided. Upon actuation of the ball return system, the return channels of the invention are inclined to a degree to ensure that balls contained therein will readily roll down the channel as described. The selective orientation of the return channels in an inclined position ensures that balls contained therein will be readily returned without the possibility of becoming entrapped within the channels. Also seen in FIGS. 6 and 7, is the provision of a raised area 174 associated with ball ejection holes 110 which provide sufficient room for balls returning within channels 130 to be ejected from the channels and onto playing surface 102. Such a feature may also be desirable in association with the ball retaining hole members 44 as described with reference to the preceding embodiment. By slightly raising playing surface 102 adjacent the ball retaining hole members 44, the height at which the playing surface of the apparatus must be disposed above the ground plane is minimized. The entire assembly may therefore be situated closer to the ground as desired, and it has also been found that the raised portions adjacent the holes of the apparatus will deflect any balls coming off the border of the playing surface to avoid the making of luck shots for game competition or the like.

Figure 8:
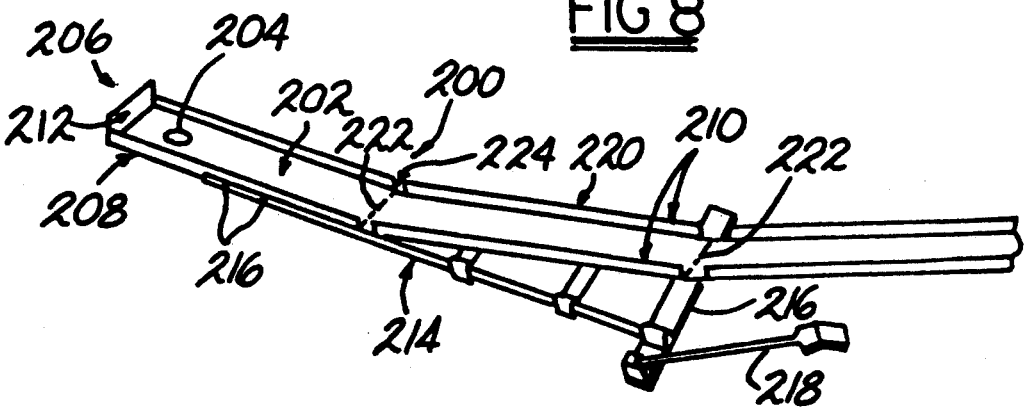
FIG. 8 shows a perspective view of another alternate embodiment of the putting practice and game apparatus of the invention showing additional modifications which allow the apparatus to be adaptable for a variety of applications.

Turning now to FIG. 8, another embodiment of the invention is shown. In this embodiment, the putting practice and game apparatus 200 is similar in many respects to the embodiment of FIG. 1. In this embodiment, the length of the apparatus 200 is extended for longer putts, and more particularly may be used for lengths of 10 to 20 feet or more. The apparatus 200 again comprises an elongated playing surface 202, being a soft resilient material to simulate a putting green. At least one target hole 204 is provided at a first end 206 similar to that previously described. In this embodiment, the playing surface 202 is supported by a supporting base member 208 which is comprised of a rigid lightweight material such as cardboard or plastic. The base member 208 is formed with integral side walls 210 and an end wall 212, which in conjunction with the bottom wall of base member 208 form a box-like structure. The playing surface 202 may be secured into the box-like structure formed by the base member 208. It should also be recognized that the integral side and end walls 210 and 212 of the base member 208 act to retain any putted balls on the playing surface 202, such that the elastic border utilized in previous embodiments is no longer needed along with the supporting posts therefore. The base support member 208 may again be carried on a lift frame 214, which is coupled to the base support 208 by small bolts 216 or the like adjacent first end 206. The lift frame 214 may include two side members which are coupled directly to the box-like base structure 208. The lift frame 214 does not require cross supports extending between the side members as the rigidity of the base member and integral sidewalls allow this structure to be lifted in conjunction with the lift frame. The construction again may include a lift base 216 and actuating lever 218, utilized to pivot the lift frame 214 upwardly and raise first end 206 of the apparatus 200 to an inclined position relative to the ground plane. In this embodiment, the base member 208 having integral sidewalls 210 and 212 may act as a carrying case when the assembly is folded up such that the apparatus is easily portable. When the playing surface has a significant length, a problem may exist in that putted balls may not be properly returned to the player upon actuation of the ball return mechanism as not enough return speed may be provided to return all balls regardless of their position on playing surface 202. In this embodiment, the base support member 208 includes an intermediate section 220, which may be termed a surface bridge, wherein portion 220 of base member 208 is pivotally attached to the other portions of base member 208 such that upon actuation of the ball return mechanism, the orientation of surface bridge 220 forms a separately inclined portion relative to first end 206. The surface bridge 220 enables any balls on surface 102 to gain the proper return speed to ensure proper ball return. The surface bridge 220 may be coupled to the other portions of base member 208 by means of score lines 222, such that base member 208 will crease at the zones to form an extended ramp for ball return. The side walls 210 of base member 208 may be provided with gaps 224 at the locations of score lines 222 to allow the pivotal motion between these portions of base member 208 as desired. The provision of a surface bridge 220 ensures that all balls putted on playing surface 202 will be assuredly returned to the player upon lifting of end 206 by means of lift frame 214, which may be especially important with longer playing surfaces. It should also be recognized that some of the features as described in this embodiment are suitable for use with other embodiments of the invention, such as the formation of base member 208 having integral side and end walls 210 and 212 respectively. The use of a support base of this construction may avoid the use of cross bars in the lift frame of the device, and the lift frame need not extend the full length of the apparatus adjacent the first end thereof.

Although very specific embodiments of the invention have been described herein, it should be apparent that a wide variety of modifications or variations are possible in the construction and contemplated thereby. It should therefore be understood that such modifications or changes may be made without departing from the spirit and scope of the invention as defined in the appended claims.

What is claimed is:

1. A putting practice and game apparatus comprising;

an elongated playing surface having first and second ends and at least one target hole formed therein at a position relative to said playing surface first end, wherein balls will be putted from said second end towards said first end and said at least one target hole, said at least one target hole includes retaining means being formed as having at least one elongated channel with side walls and a bottom wall, wherein said bottom wall has a first end thereof positioned adjacent said playing surface and is inclined downwardly from said first end and of said bottom wall relative to said playing surface to form a ramp on which a plurality of balls can be retained and supported, a first frame means positioned adjacent said first end of said playing surface and adapted to support and carry said first end of said playing surface therewith, said first frame means having associated therewith a lift base being positioned intermediate said first and second ends of said playing surface, means associated with said lift base to allow said first frame means to be pivoted upwardly about said lift base so as to allow said first end of said playing surface to be selectively raised, wherein any balls on said playing surface or within said means to retain a plurality of balls associated with said at least one target hole will be returned to said second end of said playing surface, wherein upon raising of said playing surface, said bottom wall of said retaining means will be inclined upwardly relative to said playing surface due to the raising of said playing surface such that any balls within said retaining means will be made to roll down said bottom wall and out of said target hole onto said playing surface.

2. The putting apparatus of claim 1, further comprising a support base on which said playing surface is positioned, wherein said first frame means is adapted to carry said support base in conjunction with said playing surface.

3. The putting apparatus of claim 1, wherein, said playing surface is a soft resilient material which simulates the surface on a putting green.

4. The putting apparatus of claim 1, further comprising, a border provided around at least said first end of said playing surface to retain balls on said playing surface.

5. The putting apparatus of claim 1, further comprising, adjusting means associated with said first frame means which allow the configuration of said playing surface to be locally varied.

6. The putting apparatus of claim 1, wherein, said means associated with said lift base is an actuating lever connected to said end wall and adapted to have a force applied thereto to cause pivoting of said lift base and said first frame means.

7. The putting apparatus of claim 1, wherein, said means associated with said lift base is a second frame means, wherein said second frame means is upwardly inclined relative to said first frame means such that a downward force applied to said second frame means will cause said first frame means to be pivoted upwardly about said lift base.

8. The putting apparatus as in claim 7, wherein, said second frame means includes a weight bar which will counterbalance the weight of said first frame means such that the force necessary to urge said second frame means downwardly is reduced.

9. The putting apparatus as in claim 2, wherein, said support base is constructed of a plurality of members which are pivotally engaged to one another to allow selective orientation of said plurality of members relative to one another.

10. The putting apparatus of claim 9, wherein, said plurality of members includes a central elongated member having two elongated side panels pivotally coupled thereto, and including means to adjust the height of each of said side panels relative to said central member to selectively vary the configuration of the playing surface.

11. The putting apparatus of claim 1, further comprising, a ball storage and retrieval assembly positioned adjacent said second end of said playing surface and adapted to accept balls returned along said playing surface for storage and selective retrieval.

12. The putting apparatus of claim 11, wherein said ball storage and retrieval assembly includes a trough having a bottom wall which is inclined downwardly from said playing surface, a ball runway extending upwardly from a rear portion of said trough so as to extend at least to the height of said playing surface, a ball retaining means positioned adjacent said ball runway, and means associated with said trough to enable the back of said trough to be selectively lifted upwardly, wherein a ball located in said ball retaining means will be made to roll on said ball runway to be disposed on said playing surface.

13. A putting practice and game apparatus comprising;

an elongated playing surface having first and second ends and at least one target hole formed therein at a position relative to said playing surface first end, wherein balls will be putted from said second end towards said first end and said at least one target hole, said at least one target hole includes retaining means being formed as having at least a first channel positioned to accept balls falling into said at least one target hole, and a second channel coupled to said first channel at a first end thereof to accept balls from said first channel and connected at its second end to an additional hole formed in said playing surface, a frame means positioned adjacent said first end of said playing surface and adapted to support and carry said first end of said playing surface therewith, said frame means having associated therewith a lift base being positioned intermediate said first and second ends of said playing surface, means associated with said lift base to allow said frame means to be pivoted upwardly about said lift base so as to allow said first end of said playing surface to be selectively raised wherein any balls on said playing surface or within said means to retain a plurality of balls associated with said at least one target hole will be returned to said second end of said playing surface, wherein upon lifting of said first end of said playing surface, balls retained in said first and second channels will be directed through said second channel and ejected from said additional hole formed in said playing surface.

* * * * *